United States Patent [19]

Mizer

[11] Patent Number: 4,967,448

[45] Date of Patent: Nov. 6, 1990

[54] COTTONSEED PROCESSING APPARATUS

[75] Inventor: Michael A. Mizer, Plano, Tex.

[73] Assignee: Carver Incorporated, Carrollton, Tex.

[21] Appl. No.: 299,229

[22] Filed: Jan. 23, 1989

[51] Int. Cl.[5] ..... D01B 1/04; D01B 1/08

[52] U.S. Cl. ..... 19/40; 19/48 R; 19/55 A; 19/64.5

[58] Field of Search ..... 19/55 A, 40, 41, 55 B, 19/55 R, 48 R, 58, 59, 60, 64.5

[56] References Cited

U.S. PATENT DOCUMENTS

| | | | |
|---|---|---|---|
| Re. 22,542 | 9/1944 | Ricker | 19/41 |
| 732,869 | 7/1903 | Larson . | |
| 848,611 | 3/1907 | Casebolt | 19/40 |
| 1,089,318 | 3/1914 | Camp | 19/58 |
| 1,380,677 | 6/1921 | Pool | 19/55 A |
| 1,401,439 | 12/1921 | Pettit | 19/59 |
| 1,426,687 | 8/1922 | Vardell | 19/58 |
| 2,224,272 | 3/1940 | Myers et al. | 19/55 R |
| 2,310,598 | 2/1942 | Ricker | 19/41 |
| 2,318,737 | 5/1943 | Blaylock | 19/58 |
| 2,328,126 | 8/1943 | Carr et al. | 19/58 |
| 2,655,695 | 7/1950 | Ford | 19/55 R |
| 2,736,068 | 2/1956 | Lopez | 19/59 |
| 2,738,553 | 3/1956 | Davis, Jr. | 19/41 |
| 3,919,742 | 11/1975 | Arifov et al. | 19/41 |
| 4,102,017 | 7/1978 | Foerster | 19/58 |
| 4,262,390 | 4/1981 | Einglett et al. | 19/64.5 |
| 4,699,049 | 10/1987 | Mizer | 19/35 |
| 4,723,342 | 2/1988 | Strother et al. | 19/40 |

OTHER PUBLICATIONS

"HC—2 High Capacity Delinter" by Murray-Carver, Inc., date not known.

"Carver High Capacity Linter" by Carver Cotton Gin Co., publication date unknown.

"Murray Carver" publication date unknown.

"Cotton's Other By-Product" by Murray-Carver, Inc., publication date unknown.

"The Delinting of Cottonseed" by M. C. Verdry printed Jun. 1979.

*Primary Examiner*—Werner H. Schroeder

*Assistant Examiner*—Michael A. Neas

*Attorney, Agent, or Firm*—Kenneth R. Glaser

[57] ABSTRACT

An improved cottonseed delinter includes a magnetic tramp metal separating system in conjunction with a roll feeder. Cylinder saw lifting arms are integrally mounted for pivotal co-movement with a gratefall cover, and a gratefall cover is mounted for outward pivoting movements about a horizontal axis located in a lower portion of the gratefall cover. Makeup air for a pneumatic moting and lint conveying system is routed through delinted seeds in order to remove fly lint.

19 Claims, 6 Drawing Sheets

COTTONSEED PROCESSING APPARATUS

TECHNICAL FIELD

The present invention relates in general to cottonseed processing apparatus, and more particularly to cottonseed delinters.

BACKGROUND OF THE INVENTION

Unprocessed cotton brought from the field to a cotton gin for ginning will produce bales of long cotton fibers while the remaining cottonseed will have a residue of lint thereon. Cottonseed processing apparatus has long been used to remove residue lint from cottonseeds which have already been processed in conventional cotton gins to remove the long, staple fibers from the seeds. The lint removed from the cottonseed is one of the salable products procured from the cotton operation.

Lint is typically removed in multiple passes through a cottonseed processing apparatus known as a delinter. The first pass lint yields high quality cellulose, used in manufacturing high quality paper. Lint from the second and third passes is usually sold in blended form, with munitions lint and hygienic cottonballs being common end uses.

It is also desirable to delint seeds to enhance processability for oil extraction. In oil extraction apparatus, lint is a contaminant which detracts from the overall quality of the oil and adds to the maintenance requirements for the oil extraction apparatus.

In the conventional delinter, the lint is continuously removed from seed by subjecting a rotating mass of seed or "seed roll" to a rotating, ganged cylinder of toothed saw blades passing between ribs in a "grate". The lint is "doffed" from the sawteeth by a revolving brush cylinder.

The seed roll is rotated in a "float chamber" where the seed roll is subjected to the saws. Rotation of the seed roll is caused by a rotating paddle wheel "float" in the center of the seed roll.

The density of the see roll in the float chamber is controlled by a feedback controlled paddle wheel roll feeder upstream of the float. The rotating speed of the roll feeder is determined by the amperage required by the saw cylinder motor, such that see roll density is maintained at an optimum level for efficient delinting.

In use, the saw cylinders wear rapidly and require frequency sharpening, so a convenient means of accessing and removing the saw cylinder is required. The conventional delinter thus also includes pivoted gratefall cover pivotally attached to the delinter at the top thereof to enable access to the saw cylinder. The upwardly pivoting gratefall cover requires substantial force to shift it to its open position. In addition, suspension of the gratefall cover above the saw cylinder requires the use of separate saw cylinder shifting arms to lift the saw cylinder from its mounts within the machine and then roll the cylinder outwardly a sufficiently distance to enable access to an overhead crane or cart. This prior art technique of saw cylinder removal is time consuming and inefficient and requires substantial skill on the part of the operator.

It is also known to provide a flat permanent magnet underneath an apron in the seed stream between the roll feeder and the float chamber for the purpose of detaining ferrous "tramp metal". Tramp metal are metallic trash objects such as fasteners that accidentally get mixed into the incoming cottonseeds. While it is extremely infrequent to encounter a trash metal object, it is imperative that some means be provided to prevent such objects from entering the float chamber, where a tramp metal object could cause significant and substantial damage to the saw cylinder. A drawback of the prior art flat magnet tramp metal detainment apparatus i that the tramp metal is not actually separated from the seed flow, and it requires that an operator notice the tramp metal object detained by the magnet on the apron and physically remove it from the seed stream.

The value or price of lint is determined by the percent of foreign matter or "trash" such as broken hulls, kernels, etc. in the lint, and therefore it is also desirable to remove such trash from the lint in the delinter. "Moting", the removal of trash ("motes") from the lint, is accomplished by gravity in a moting chamber, where the heavier or more dense motes fall through an upwardly-flowing airstream created pneumatically to carry away the lint. Typically, makeup air for the moting chamber has been provided through any convenient opening towards the bottom of the apparatus, such as through the motes conveyor chamber directly below the moting chamber.

Another significant drawback to prior art apparatus has been the incidence of fly lint in the delinted seed stream. Fly lint is the lint which escapes with the delinted seeds rather than being removed by the saw cylinders. In the delinted seed stream, fly lint is an unwanted contaminant and it has proved problematic and expensive in the past to control the amount and presence of fly lint in the delinted seeds.

Thus, it can be seen that conventional delinting apparatus currently in use suffers from a number of significant drawbacks. A need presently exists for eliminating these drawbacks, to yield delinting machinery which enables higher efficiency delinting and better quality lint than has previously been obtained.

SUMMARY OF THE INVENTION

The present invention is an improved cottonseed delinter which eliminates many of the aforementioned drawbacks of conventional, prior art delinting apparatus. In one aspect of the invention, a semi-cylindrical magnetic field is projected through a paddle-wheel feed roller to retain tramp metal for separation from the main flow of incoming seed. In another aspect of the invention, cylinder saw lifting arms are fixed for co-rotation with a front gratefall cover, with the gratefall cover being pivotally mounted adjacent a lower portion thereof for downward rotation to the open position. In yet another aspect of the invention, makeup air for the pneumatic moting and lint removal system is routed through the delinted seed stream to remove fly lint therefrom and to prevent settling of lint upon the machinery inside the apparatus housing.

BRIEF DESCRIPTION OF THE DRAWINGS

A more complete understanding of the invention and its advantages will be apparent from the Detailed Description of the Preferred Embodiment, taken in conjunction with the accompanying Drawings in which.

DETAILED DESCRIPTION OF THE PREFERRED EMBODIMENT

Figure 1:
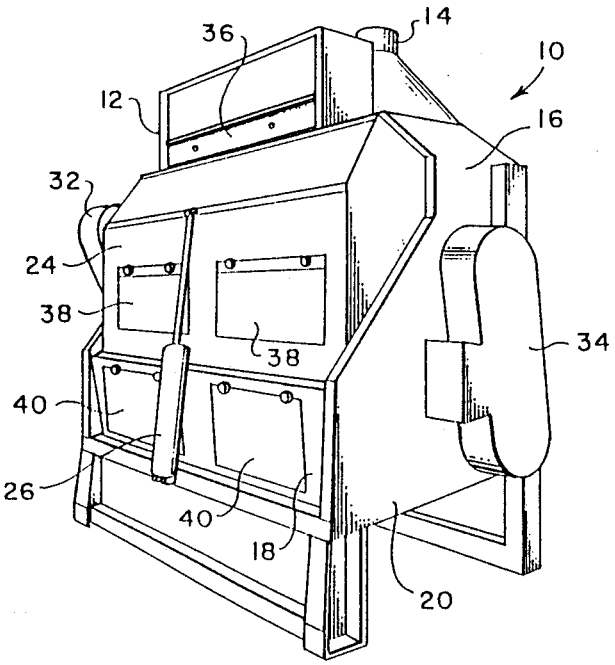
FIGS. 1 and 2 are perspective views of the improved cottonseed delinter.
Figure 2:
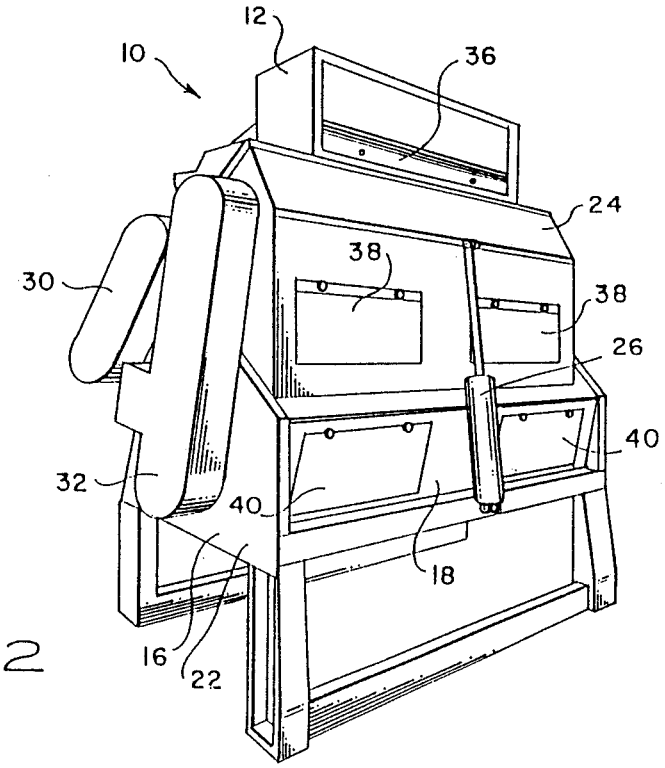

Referring initially to FIGS. 1 and 2, cottonseed processing apparatus 10 constructed in accordance with the invention is of the type generally known as a cottonseed delinter, wherein undelinted cottonseeds enter at cottonseed inlet 12, lint is removed from lint outlet 14, and delinted cottonseeds and motes drop from delinter 10 through outlets (not shown) located at the bottom thereof. Delinter 10 includes a housing 16 having a plurality of walls including a front wall 18, side walls 20 and 22, and back and top walls (not shown). A gratefall cover 24 is pivotally mounted to side walls 20 and 22 for movements between open and closed positions by activation of hydraulic piston and cylinder assembly 26. A brush drive cover 30, float drive cover 32 and saw drive cover 34 are provided to protect various drive components of the apparatus. A door 36 is provided in cottonseed inlet 12 for the removal of tramp metal separated from the incoming undelinted cottonseeds. Inspection doors 38 in gratefall cover 24 enable inspection of the delinting process, while sampling doors 40 enable the taking of delinted seed samples.

Figure 3:
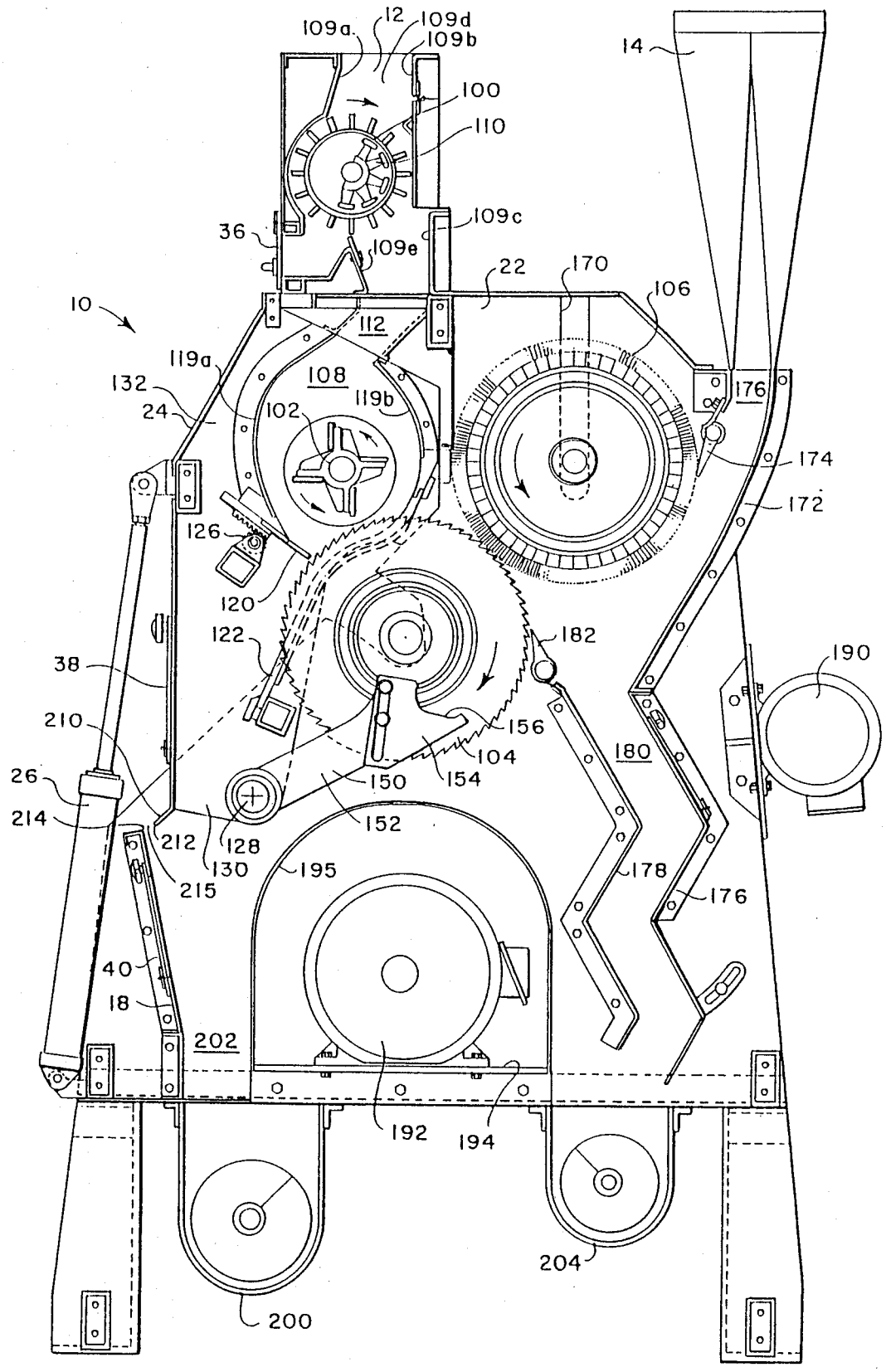
FIG. 3 is a partially broken-away elevation view of the improved cottonseed delinter with the gratefall cover shown in the closed position.
Figure 4:
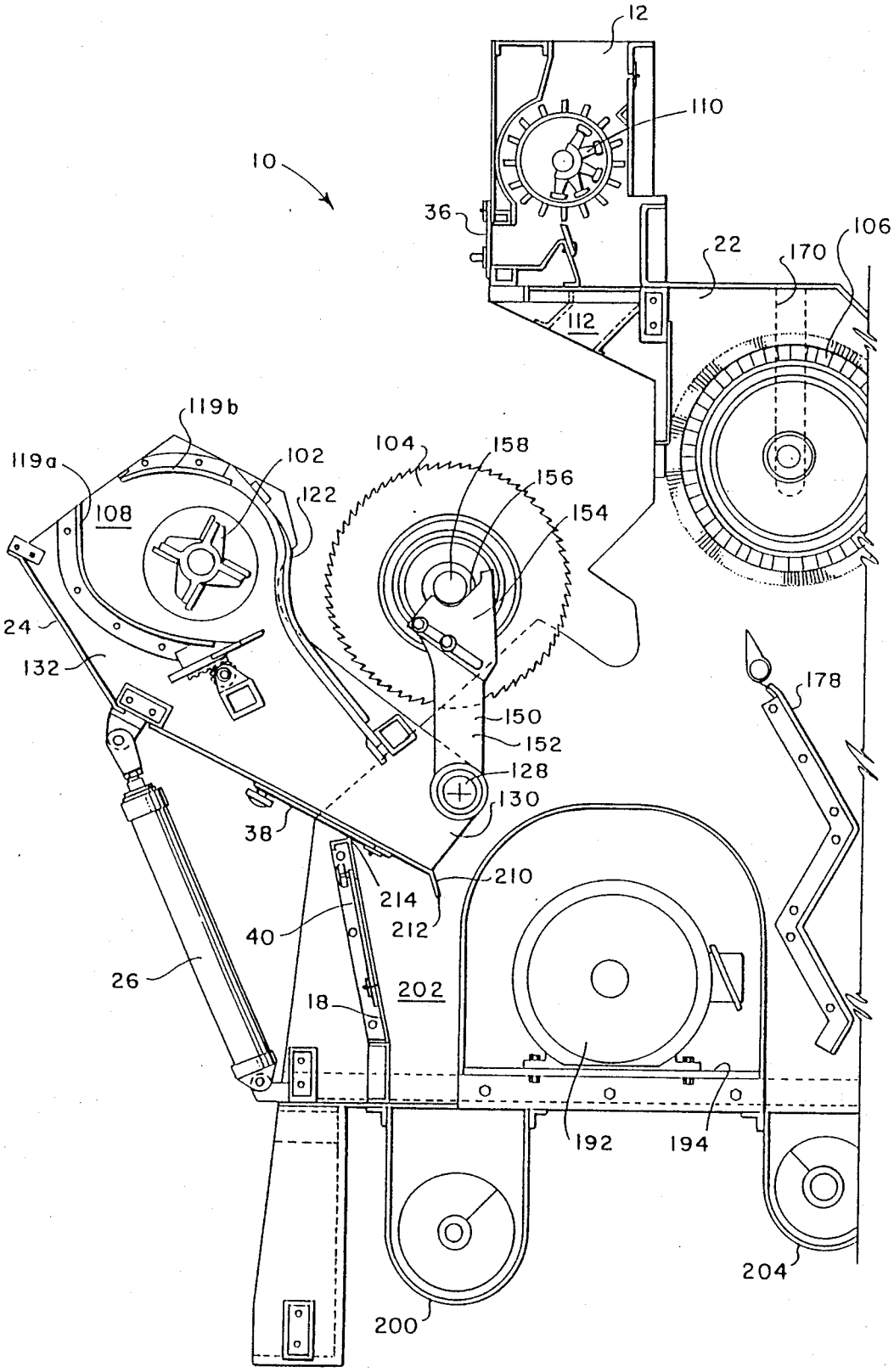
FIG. 4 is a partially broken-away elevation view of the delinter of FIG. 3, with the gratefall cover being pivoted to the open position.

Referring now to FIGS. 3 and 4, the primary moving elements of delinter 10 are roll feeder 100, float 102, saw cylinder 104, and brush 106. In conventional form, roll feeder 100 controls the density of the seed roll in float chamber 108, where saw cylinder 104 acts upon the undelinted seeds to remove lint, which lint is then doffed from saw cylinder 104 by brush 106.

More particularly, roll feeder 100 is mounted for rotation within inlet walls including a front inlet wall 109*a*, an upper back inlet wall 109*b*, a lower back inlet wall 109*c*, side inlet walls 109*d*, and a separator inlet wall 109*e*. A stationary magnet assembly 110 is provided to separate tramp metal from the incoming stream of undelinted seeds, as will be described in more detail below in connection with FIGS. 7 and 8. An inlet chute 112 receives undelinted seeds from inlet walls 109*c*, 109*d* and 109*e* and conveys them to float chamber 108. Float chamber 108 is defined by outer float chamber panel 119*a* and inner float chamber panel 119*b*.

A rake 120 and grate 122 are fixed to gratefall cover 24. It will be understood that grate 122 includes a plurality of ribs spaced to interleave with the ganged saws of saw cylinder 104 in conventional fashion. The proximity of rake 120 to float 102 is adjustable by way of rack and pinion mechanism 126. As best shown in FIG. 4, rake 120, float 102 and grate 122 are fixed for comovement with gratefall cover 24. Also as shown in FIG. 4, retraction of hydraulic piston and cylinder assembly 26 causes gratefall cover 24 to pivot to its open position about horizontal axis 128. Axis 128 extends through a lower portion 130 of gratefall cover 24, such that an upper portion 132 of gratefall cover 24 pivots outwardly from the delinter housing.

Saw cylinder 104 is engaged with housing side walls 20 and 22 for axial rotation within the housing. Two identical cylinder lifting arms 150 extend radially from axis 128. Each arm 150 includes an arm member 152 and a pocket member 154. Pocket members 154 include walls 156 which define pockets for engaging end shaft portions 158 of saw cylinder 104.

Brush 106 is slidably mounted in slot 170 for adjustments relative to saw cylinder 104. In conventional fashion, brush 106 doffs saw cylinder 104 to remove lint therefrom. Lint discharge panel 172 and seal 174 define exit chute 176 in communication with lint outlet 14. Moting chamber outside panel 176 and inside panel 178 define moting chamber 180 in combination with seal 182. Panels 176 and 178 are shaped to form a cascade in order to improve the efficiency of the moting chamber. Brush motor 190 drives brush 106 by way of a belt and pulley arrangement (not shown). Similarly, saw motor 192 drives saw cylinder 104. Saw motor 192 is mounted to a base 194, which also supports a float motor (not shown) for driving float 102. A tunnel 195 covers the saw and float motors.

A delinted seed auger 200 is provided beneath delinted seed outlet 202 to carry away delinted seeds escaping through rake 120. Similarly, motes auger 204 is provided to carry motes dropping from moting chamber 180.

Gratefall cover 24 includes at its lower, outer edge an apron 210 having an edge 212. Front housing wall 18 has an upper edge 214 which is spaced apart from edge 212 of apron 210. The gap between edges 212 and 214 is the only opening between the interior of the housing and the exterior and defines the makeup air inlet 215 for the moting and lint removal system.

Figure 5:
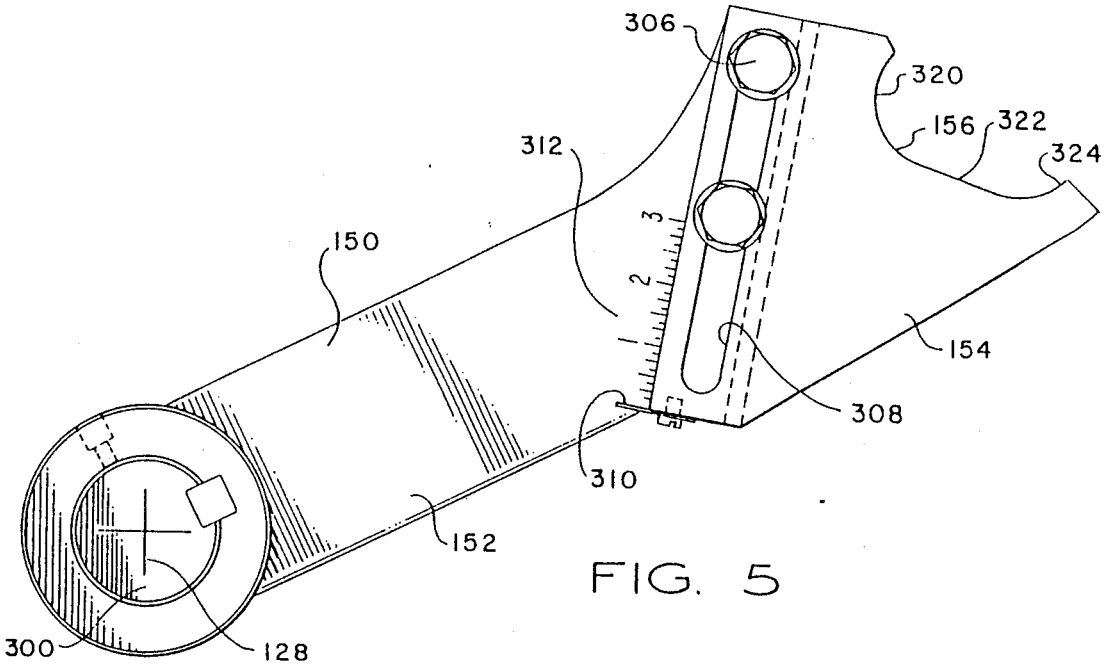
FIG. 5 is a side view of a cylinder saw lifting arm usable in accordance with the invention.
Figure 6:
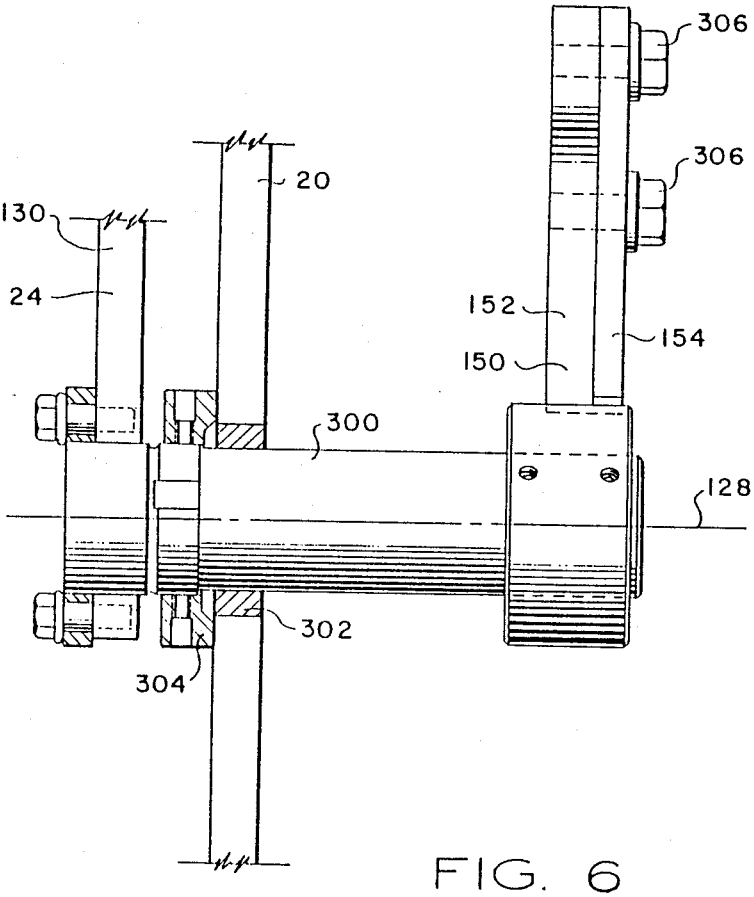
FIG. 6 is a partial end view of the cylinder saw lifting arm of FIG. 5 mounted to the gratefall cover.

Referring now to FIGS. 5 and 6, each of the lifting arms 150 is connected to a shaft 300 which passes through the adjacent side wall 20 or 22. Shaft 300 is mounted in side wall 20 or 22 by way of a bushing 302 and is restrained for axial movement by way of a collar 304. Lower portion 130 of gratefall cover 24 is fixed to shaft 300 for coaxial pivotal movements with the lifting arms. Pocket members 154 are mounted for selectively fixable sliding movements with respect to arm members 152. Specifically, the relative position between members 152 and 154 may be selected by loosening bolts 306 and sliding pocket member 154 along a linear path defined by elongated slot 308. An indexing pointer 310 is provided on pocket member 154 for registration with an indexing scale 312 inscribed upon arm member 152. Walls 156 define a generally concave upwardly pocket having a curved outer portion 320, a planar portion 322 and a curved inner portion 324.

Figure 7:
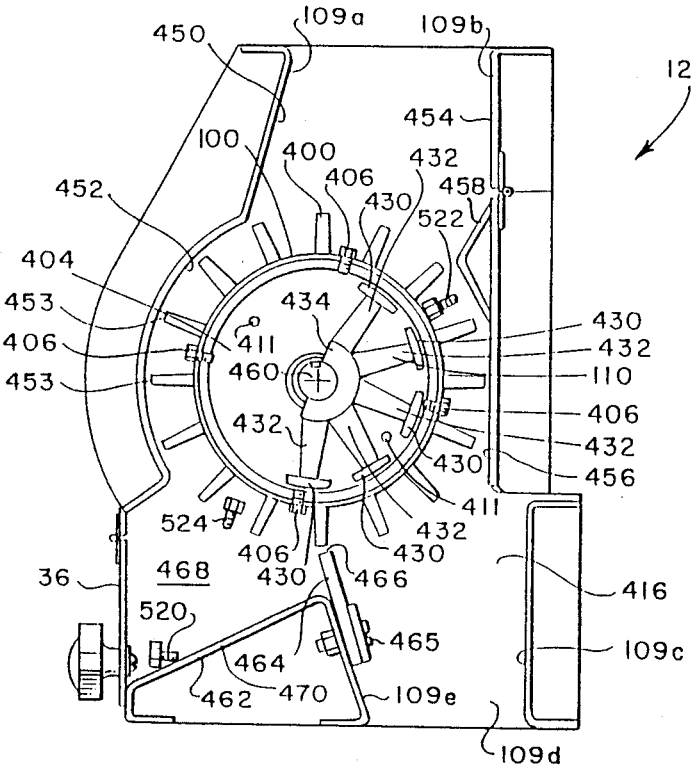
FIGS. 7 and 8 are partially broken-away views of a feed roller and tramp metal removing magnet usable in accordance with the invention.
Figure 8:
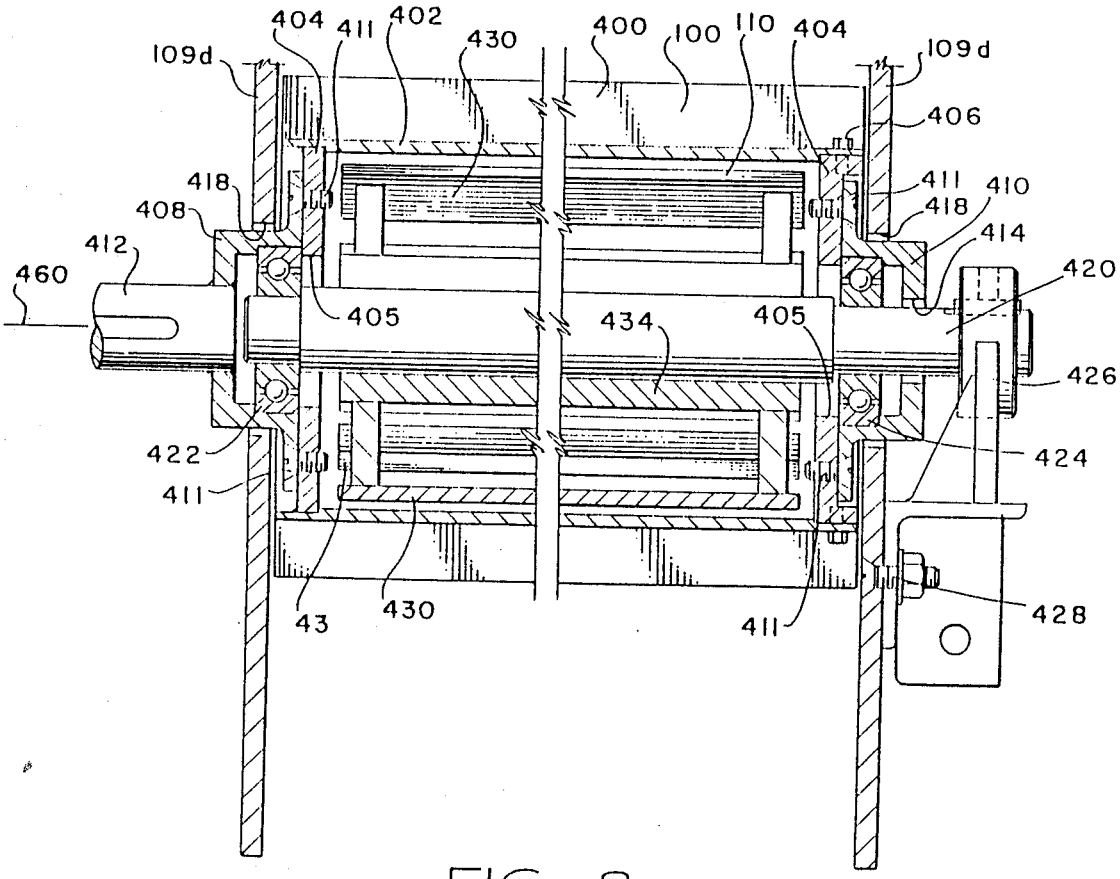

Referring now to FIGS. 7 and 8, roll feeder 100 is a paddle wheel structure having paddles 400 extending outwardly from a cylindrical drum 402. End plates 404 include cylindrical walls 405, which define central openings therein, and drum 402 is connected to end plates 404 by way of fasteners 406. End plates 404 are connected to drive collar 408 at one end and open collar 410 at the other end. Drive collar 408 is connected to drive shaft 412, whereas open collar 410 includes cylindrical inner walls 414 defining an opening therein. Each of the side walls 109*d* of inlet 12 includes cylindrical walls 418 which define openings through which drive collar 408 and open collar 410 protrude. Plates 404 are connected to drive collar 408 and open collar 410 by way of fasteners 411. Collars 408 and 410 are rotatably mounted to a stationary shaft 420 by way of bearings 422 and 424, respectively. Stationary shaft 420 is keyed to a mount 426 fixed to one of the side walls **109*d* by way of fasteners 428. Magnet assembly 110 is fixed to stationary shaft 420. Magnet assembly 110 includes permanent bar magnets 430 fixed to radial arms 432, which in turn are fixed to base 434. Base 434 is fixed to shaft 420**.

Front inlet wall **109*a* includes an inclined upper portion 450 and a semi-cylindrical lower portion 452 dimensioned to closely enclose a segment of roll feeder 100's circle of rotation, which circle of rotation is defined by outer edges 453 of paddles 400. Upper back inlet wall 109*b* is composed of a fixed upper portion 454 and a pivotal lower portion 456 hingedly connected at a top edge thereof to a lower edge of upper portion 454. An angular weir member 458 projects outwardly from lower portion 456 towards roll feeder 100's circle of rotation at a vertical location located above roll feeder axis 460 to enable efficient seed advancement by roll feeder 100. Separator inlet wall 109*e* is the innermost surface of separator 462. An adjustable divider member 464 is connected to inlet wall 109*e* for slidable movements with respect thereto by way of fasteners 465, such that the spacing between top edge 466 and roll feeder 100's circle of rotation may be finely adjusted. A tramp metal storage area 468 is defined by a separator wall 470 sloping downwardly from divider member 464 and by door 36**.

Figure 9:
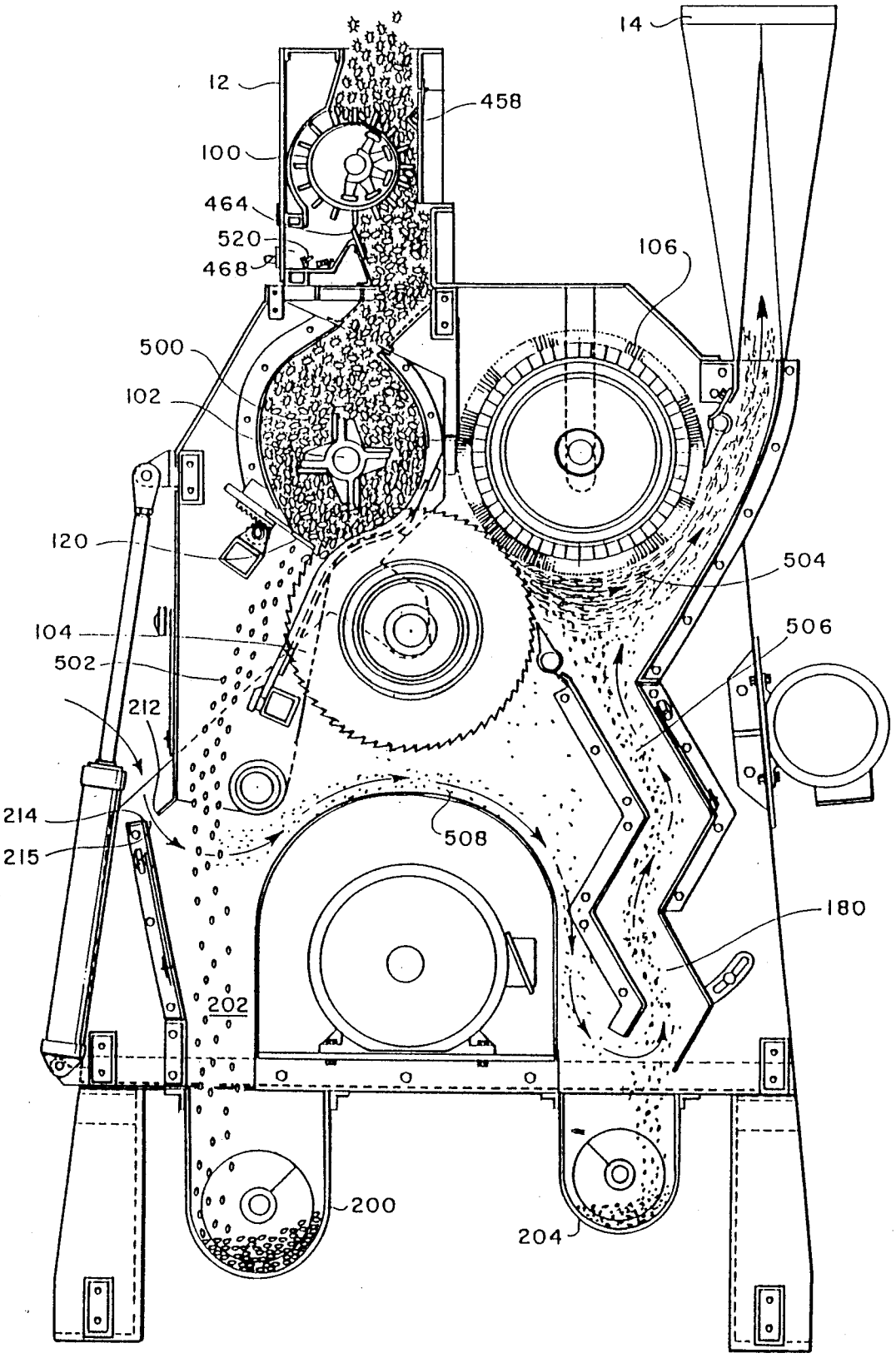
FIG. 9 is a schematic view illustrating the improved cottonseed delinter in operation.

In operation, as illustrated in FIG. 9, undelinted seed is conveyed to inlet 12 where roll feeder 100 maintains a pre-selected density of the seed roll 500. Seed roll 500 is continually rotated by way of float 102 past the rotating saw cylinder 104. The teeth of saw cylinder 104 delint the seeds in seed roll 500 until the seeds are sufficiently reduced in size to pass through the space defined by the tip of rake 120 and the teeth of saw cylinder 104. Delinted seeds 502 then drop through seed outlet 202 to delinted seed auger 200. Meanwhile, brush 106 doffs lint 504 from saw cylinder 104. Motes 506 are separated from lint 504 by reduced air pressure applied to the lint outlet 14. Makeup air for the pneumatic lint conveying system enters the delinter housing at makeup air inlet 215 defined by edges 212 and 214. The makeup air is at a greater pressure relative to the air pressure at lint outlet 14. Flow of air from the makeup air inlet 215 through the housing is routed through delinted seeds 502 being conveyed to the delinted seed outlet 202. Makeup air thus removes the lightweight fly lint 508 from the delinted seed 502 prior to its entry into seed outlet 202. Fly lint 508 is carried up through moting chamber 180 to the main flow of lint 504 up into lint outlet 14. The heavier weight motes 506 descend through the opposing airstream in noting chamber 180 to motes auger 204.

Referring now to FIGS. 7 and 8, in addition to FIG. 9, ferrous tramp metal is completely separated from the incoming undelinted seeds in inlet 12. Magnets 430 are arranged to project a semi-cylindrical magnetic field through cylindrical drum 402, such that a first tramp metal object 522 is firmly held adjacent to cylindrical drum 402 during the segment of roll feeder 100's circle of rotation between weir member 458 and divider member 464. The semi-cylindrical magnetic field projects into the undelinted cottonseed throughout such segment but terminates in tramp metal storage area 468. Thus, as shown in FIG. 7, a second tramp metal object 524 is shown released from magnetic contact with drum 402 and dropping into tramp metal storage area 468 to join a third tramp metal object 520. To remove tramp metal objects, door 36 is raised and the objects are collected.

Finally, as best shown in FIGS. 3 and 4, gratefall cover 24 is pivoted to its open position by action of hydraulic piston and cylinder assembly 26. Lifting arms 150, fixed for co-rotation with gratefall cover 24, pivot such that walls 156 come into contact with shaft ends 158. Upon further pivotal movement, saw cylinder 104 is lifted and supported by pocket members 154 in the position shown in FIG. 4. In such position, saw cylinder 104 can easily be lifted by way of an overhead crane and transported to a sharpening station. As continued sharpening of saw cylinder 104 will significantly decrease its overall diameter, the relative positioning of pocket members 154 and arm members 152 is adjustable by way of fasteners 306 and slot 308 to account for variable mounting locations of the cylinder saw shaft with respect to the housing.

Various modifications of the described embodiment, as well as alternate embodiments, of the invention may become apparent to those skilled in the art without departing from the spirit and scope of the invention, as defined by the appended claims.

I claim:

1. A cottonseed delinter comprising:

a housing;

apparatus disposed within said housing adapted for the delinting of cottonseeds, said apparatus including at least one saw cylinder engaged with said housing for axial rotation therewithin;

a cover mounted to said housing for movements between open and closed positions; and cylinder lift means for lifting said saw cylinder to a position for removal from the housing, said cylinder lift means being activated by moving said cover to said open position.

2. The cottonseed delinter of claim 1 wherein said cylinder lift means is fixed for co-movement with said cover.

3. The cottonseed delinter of claim 2 wherein said cover is pivotably mounted to said housing.

4. The cottonseed delinter of claim 3 wherein said cover is pivoted by operation of a hydraulic piston and cylinder assembly connected between said cover and said housing.

5. The cottonseed delinter of claim 4 wherein said cover is mounted to said housing for pivoting movements about a horizontal axis.

6. The cottonseed delinter of claim 5 wherein said horizontal axis extends through a lower portion of said cover, such that an upper portion of said cover pivots outwardly from said housing when said cover is moved to said open position.

7. The cottonseed delinter of claim 6 wherein said cylinder lift means includes at least one elongated cylinder lift arm extending radially from said axis and fixed at a first end thereof to said cover for coaxial pivotal movements with said cover.

8. The cottonseed delinter of claim 7 wherein said arm includes cylinder saw engaging means at a second end thereof opposite said first end for engaging said cylinder saw for lifting movements thereof.

9. The cottonseed delinter of claim 8 wherein said cylinder saw engaging means includes walls of said second end defining a pocket for engaging a portion of a cylinder saw shaft.

10. The cottonseed delinter of claim 9 wherein said cylinder saw engaging means is adjustable to account for variable mounting locations of said cylinder saw shaft with respect to said housing.

11. The cottonseed delinter of claim 10 wherein said walls are formed in a pocket member mounted for selectively fixable sliding movements with respect to an elongated arm member.

12. The cottonseed delinter of claim 11 wherein said cylinder lift means includes a pair of substantially identical elongated cylinder shift arms.

13. A cottonseed delinter comprising:

a housing;

apparatus disposed within said housing adapted for the delinting of cottonseeds, said apparatus including at least one saw cylinder engaged with said housing for axial rotation therewithin;

a cover pivotably mounted to said housing for movements about a horizontal axis between open and closed positions, said cover being pivoted by operation of at least one hydraulic piston and cylinder assembly connected between said cover and said housing, and said horizontal axis extending through a lower portion of said cover, such that an upper portion of said cover pivots outwardly from said housing when said cover is moved to said open position;

cylinder lift means for lifting said saw cylinder to a position for removal from the housing, said means being activated by moving said cover to said open position, and said cylinder lift means including a pair of substantially identical elongated cylinder lift arms extending radially from said axis and fixed at first ends thereof to said cover for coaxial pivotal movements with said cover; and said cylinder lift arms including cylinder saw engaging means at second ends thereof opposite said first ends for engaging said cylinder saw for lifting movements thereof, said cylinder saw engaging means including walls formed in pocket members defining pockets for engaging end portions of a cylinder saw shaft, with said pocket members being adjustably fixed to arm members to account for variable mounting locations of said cylinder saw shaft with respect to said housing, and said pocket members being mounted for selectively fixable sliding movements with respect to said arm members.

14. Cottonseed processing apparatus, comprising:

inlet passageway walls defining an inlet passageway for unprocessed cottonseeds to be processed by the apparatus;

tramp metal removing means disposed adjacent said inlet passageway for separating ferrous metal objects from said unprocessed cottonseeds conveyed through said inlet passageway;

said tramp metal removing means including a magnet located to project a magnetic field into said cottonseeds such that ferrous metal objects are separated from said unprocessed cottonseeds; and a tubular roll feeder in said inlet passageway, and said magnet being located within said roll feeder.

15. The cottonseed processing apparatus of claim 14 wherein said roll feeder has spaced paddles projecting radially from an outer cylindrical surface.

16. The cottonseed processing apparatus of claim 15 wherein said magnet projects a semi-cylindrical field into said unprocessed cottonseeds to hold said ferrous metal objects adjacent said outer cylindrical surface.

17. The cottonseed processing apparatus of claim 16 wherein said magnet is stationary with respect to the roll feeder.

18. The cottonseed processing apparatus of claim 17 wherein said magnet is disposed with respect to said inlet passageway walls such that said magnetic field terminates exterior of said inlet passageway walls and ferrous metal objects are released from said cylindrical outer surface exterior of said inlet passageway walls and outside said unprocessed cottonseeds.

19. Cottonseed processing apparatus, comprising:

inlet passageway walls defining an inlet passageway for unprocessed cottonseeds to be processed by the apparatus;

tramp metal removing means disposed adjacent said inlet passageway for separating ferrous metal objects from said unprocessed cottonseeds conveyed through said inlet passageway;

said tramp metal removing means including a magnet located to project a magnetic field into said cottonseeds such that ferrous metal objects are separated from said unprocessed cottonseeds;

a tubular roll feeder in said inlet passageway, said magnet being located within said roll feeder and being stationary with respect thereto;

said roll feeder having spaced paddles projecting radially from an outer cylindrical surface;

said magnet projecting a semi-cylindrical field into said unprocessed cottonseeds to hold said ferrous metal objects adjacent said outer cylindrical surface; and said magnet being disposed with respect to said inlet passageway walls such that said magnet field terminates exterior of said inlet passageway walls and ferrous metal objects are released from said cylindrical outer surface exterior of said inlet passageway walls and outside said unprocessed cottonseeds.

* * * * *

UNITED STATES PATENT AND TRADEMARK OFFICE

CERTIFICATE OF CORRECTION

PATENT NO. : 4,967,448

DATED : November 6, 1990

INVENTOR(S) : Michael A. Mizer

It is certified that error appears in the above-identified patent and that said Letters Patent is hereby corrected as shown below:

Column 7, line 13, "shift" should read "lift".

Signed and Sealed this

Thirty-first Day of March, 1992

*Attest:*

HARRY F. MANBECK, JR.

*Attesting Officer*

*Commissioner of Patents and Trademarks*